US005590836A

United States Patent [19]

Thielbar

[11] Patent Number: 5,590,836

[45] Date of Patent: Jan. 7, 1997

[54] FLEXIBLE CONTAINER TOY NOZZLE

[76] Inventor: Dave Thielbar, 2267 Capps Rd., York, S.C. 29745

[21] Appl. No.: 369,152

[22] Filed: Jan. 5, 1995

[51] Int. Cl.[6] ..... B05B 1/16

[52] U.S. Cl. ..... 239/391; 239/442; 239/549; 239/561

[58] Field of Search ..... 239/390–392, 239/397, 436, 442, 548, 549, 561; 222/575, 331

[56] References Cited

U.S. PATENT DOCUMENTS

| | | | |
|---|---|---|---|
| 1,798,709 | 3/1931 | Smith | 239/442 |
| 2,070,096 | 2/1937 | Smith | 222/575 X |
| 2,323,618 | 7/1943 | Ottoson | 239/391 X |
| 2,945,458 | 7/1960 | Setecka | 222/575 X |
| 2,968,262 | 1/1961 | Lacey | 222/575 X |
| 5,062,550 | 11/1991 | Singh | 239/390 X |

*Primary Examiner*—Lesley D. Morris

[57] ABSTRACT

A toy nozzle for securing to a flexible container to facilitate spraying of water therefrom. The inventive device includes a manifold having a plurality of disparate nozzles coupled thereto. Each of the nozzles can be coupled to a flexible container filled with fluid, whereby a collapsing of the container will expel fluid through the nozzle in a desired spray pattern and direction.

5 Claims, 4 Drawing Sheets

FLEXIBLE CONTAINER TOY NOZZLE

BACKGROUND OF THE INVENTION

1. Field of the Invention

The present invention relates to fluid spraying devices and more particularly pertains to a flexible container toy nozzle for securing to a flexible container to facilitate spraying of water therefrom.

2. Description of the Prior Art

The use of fluid spraying devices is known in the prior art. More specifically, fluid spraying devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art fluid spraying devices include U.S. Pat. No. 5,244,153; U.S. Pat. No. 5,052,587; U.S. Pat. No. 4,892,228; U.S. Pat. No. 4,615,488; and U.S. Pat. No. 4,597,527.

While these devices fulfill their respective, particular objectives and requirements, the aforementioned patents do not disclose a flexible container toy nozzle for securing to a flexible container to facilitate spraying of water therefrom which includes a manifold having a plurality of disparate nozzles coupled thereto, wherein each of the nozzles can be coupled to a flexible container filled with fluid, whereby a collapsing of the container will expel fluid through the nozzle in a desired spray pattern and direction.

In these respects, the flexible container toy nozzle according to the present invention substantially departs from the conventional concepts and designs of the prior art, and in so doing provides an apparatus primarily developed for the purpose of securing to a flexible container to facilitate spraying of water therefrom in a desired spray pattern and direction.

SUMMARY OF THE INVENTION

In view of the foregoing disadvantages inherent in the known types of fluid spraying devices now present in the prior art, the present invention provides a new flexible container toy nozzle construction wherein the same can be utilized for facilitating spraying of water from a flexible container. As such, the general purpose of the present invention, which will be described subsequently in greater detail, is to provide a new flexible container toy nozzle apparatus and method which has many of the advantages of the fluid spraying devices mentioned heretofore and many novel features that result in a flexible container toy nozzle which is not anticipated, rendered obvious, suggested, or even implied by any of the prior art fluid spraying devices, either alone or in any combination thereof.

To attain this, the present invention generally comprises a toy nozzle for securing to a flexible container to facilitate spraying of water therefrom. The inventive device includes a manifold having a plurality of disparate nozzles coupled thereto. Each of the nozzles can be coupled to a flexible container filled with fluid, whereby a collapsing of the container will expel fluid through the nozzle in a desired spray pattern and direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flexible container toy nozzle apparatus and method which has many of the advantages of the fluid spraying devices mentioned heretofore and many novel features that result in a flexible container toy nozzle which is not anticipated, rendered obvious, suggested, or even implied by any of the prior art fluid spraying devices, either alone or in any combination thereof.

It is another object of the present invention to provide a new flexible container toy nozzle which may be easily and efficiently manufactured and marketed.

It is a further object of the present invention to provide a new flexible container toy nozzle which is of a durable and reliable construction.

An even further object of the present invention is to provide a new flexible container toy nozzle which is susceptible of a low cost of manufacture with regard to both materials and labor, and which accordingly is then susceptible of low prices of sale to the consuming public, thereby making such flexible container toy nozzles economically available to the buying public.

Still yet another object of the present invention is to provide a new flexible container toy nozzle which provides in the apparatuses and methods of the prior art some of the advantages thereof, while simultaneously overcoming some of the disadvantages normally associated therewith.

Still another object of the present invention is to provide a new flexible container toy nozzle for securing to a flexible container to facilitate spraying of water therefrom.

Yet another object of the present invention is to provide a new flexible container toy nozzle which includes a manifold having a plurality of disparate nozzles coupled thereto, wherein each of the nozzles can be coupled to a flexible container filled with fluid, whereby a collapsing of the container will expel fluid through the nozzle in a desired spray pattern and direction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
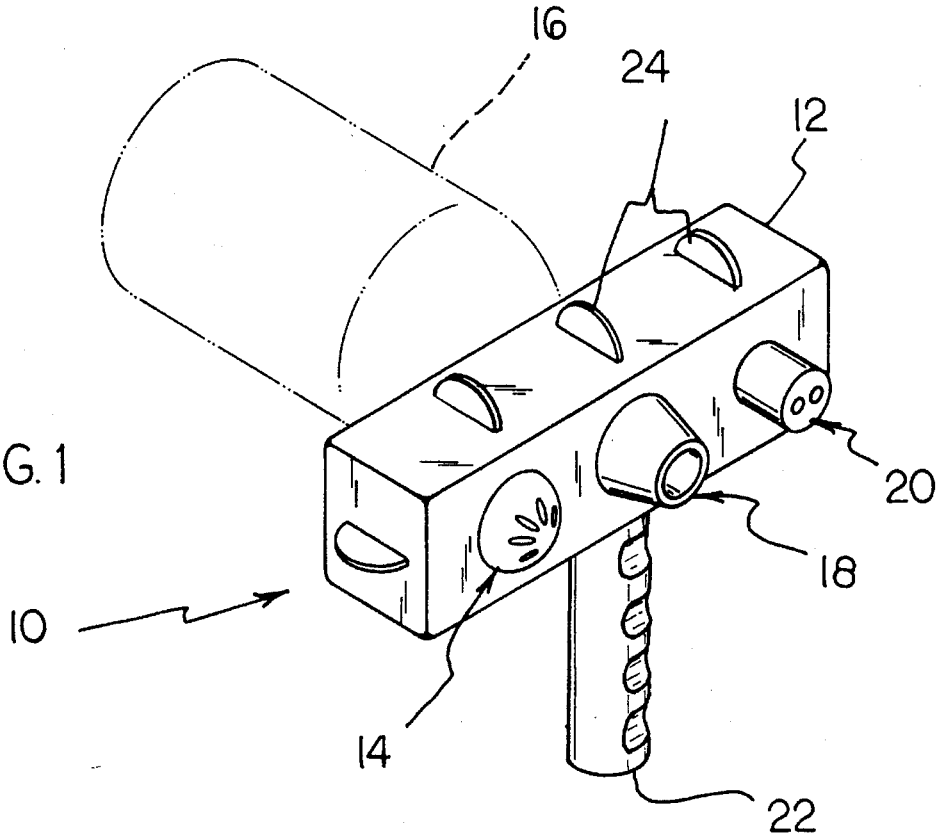
FIG. 1 is an isometric illustration of a flexible container toy nozzle according to the present invention in use.
Figure 2:
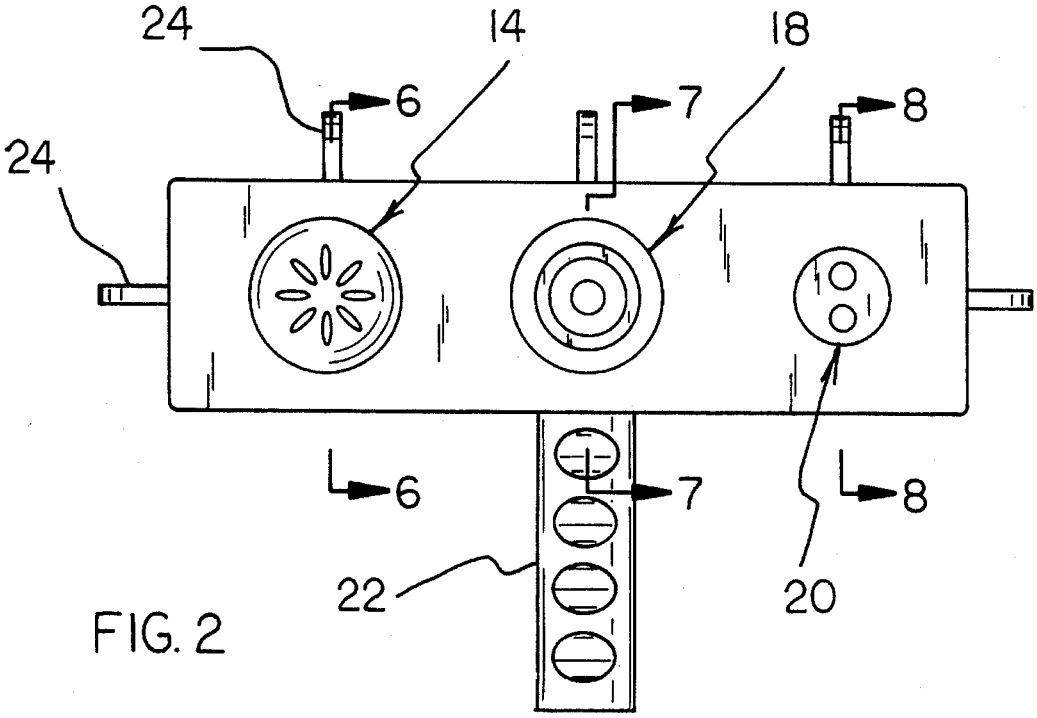
FIG. 2 is a front elevation view thereof.
Figure 3:
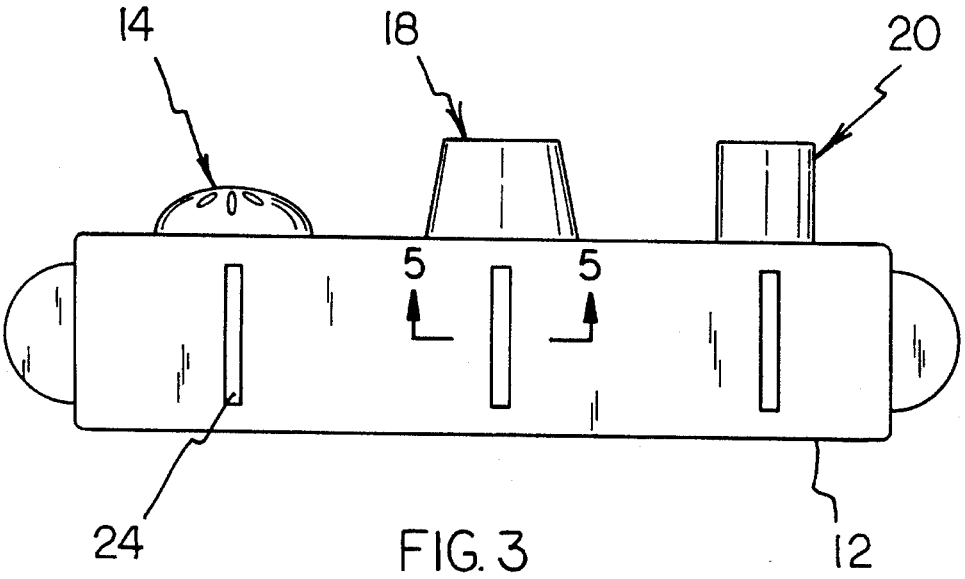
FIG. 3 is a top plan view of the invention.
Figure 4:
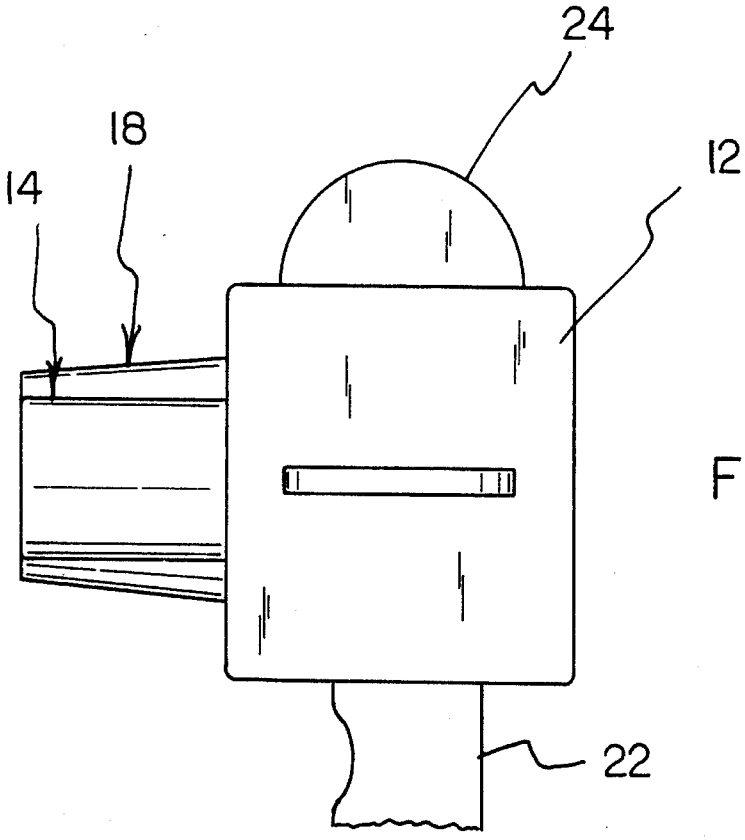
FIG. 4 is a side elevation view of the invention.

With reference now to the drawings, and in particular to FIGS. 1–8 thereof, a new flexible container toy nozzle embodying the principles and concepts of the present invention and generally designated by the reference numeral 10 will be described.

More specifically, it will be noted that the flexible container toy nozzle 10 comprises a manifold 12 having a first nozzle means 14 secured thereto for coupling to a flexible container 16 and for directing fluid forcibly expelled from the collapsible container in a desired spray pattern and direction. The present invention 10 may further include a second nozzle means 18 for coupling to a flexible container 16 and for directing fluid forcibly expelled from the flexible container in a desired spray pattern and direction. Further, a third nozzle means 20 can be provided and coupled to the manifold 12 for engaging a flexible container 16 and directing fluid forcibly expelled from the flexible container in a desired spray pattern and direction. Preferably, the spray pattern of the first nozzle means 14 is different than a spray pattern of the second nozzle means 18 or a spray pattern of the third nozzle means 20, with the spray pattern of the second nozzle means 18 also being different from the spray pattern of the third nozzle means 20. By this structure, one or more flexible containers can be selectively secured to the nozzle means 14, and 18–20 to effect direction of fluid from the manifold 12 in a desired spray pattern and direction through a simple collapsing of one or more of the flexible containers 16 utilized in conjunction with the present invention 10.

Figure 5:
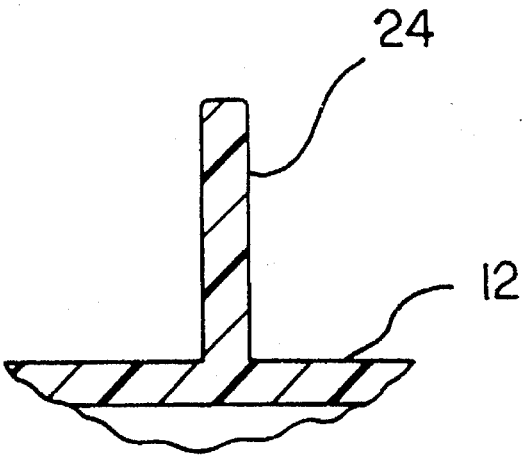
FIG. 5 is a cross-sectional view taken along line 5—5 of FIG. 3.

As shown in FIGS. 1 through 5, the present invention 10 may further comprise a handle 22 secured and projecting downwardly from a lower surface of the manifold 12 for permitting manual manipulation of the device 10 during use thereof. Further, a plurality of aiming projections 24 desirably extend from surfaces of the manifold 12 and are aligned with an individual one of the nozzle means 14, 18–20. The aiming projections 24 can be utilized by an individual to effect positioning of the device 10 prior to a distribution of fluid therefrom. As shown in FIG. 5, each of the aiming projections 24 can be integrally formed with the manifold 12 of a plastic material or the like.

Figure 6:
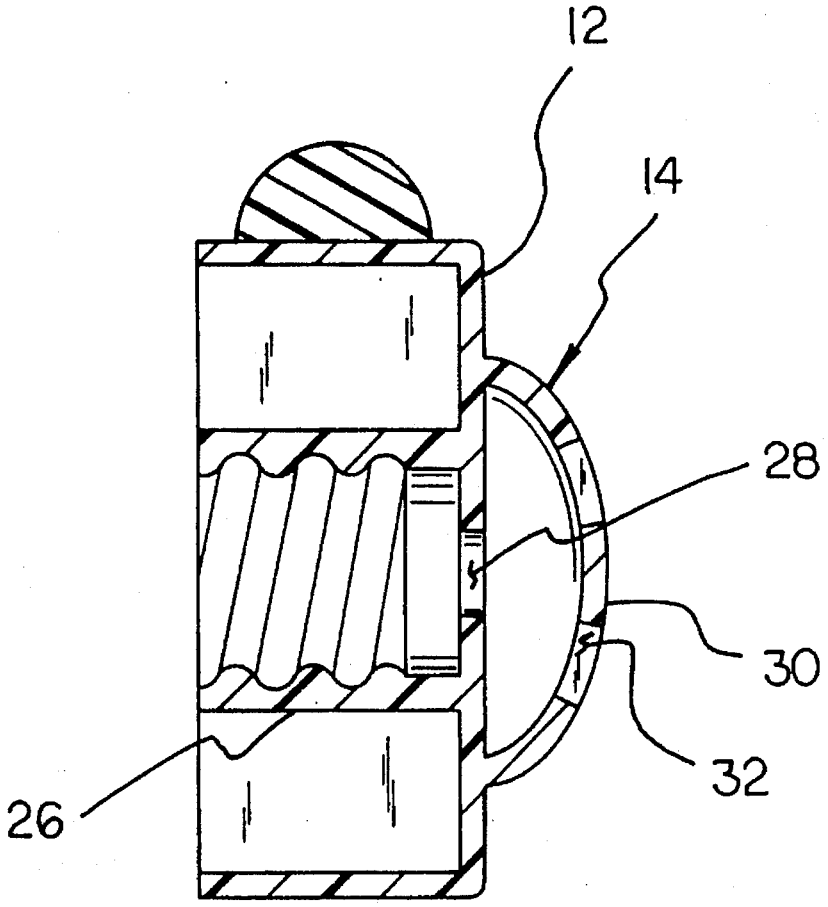
FIG. 6 is a cross-sectional view taken along line 6—6 of FIG. 2.
Figure 7:
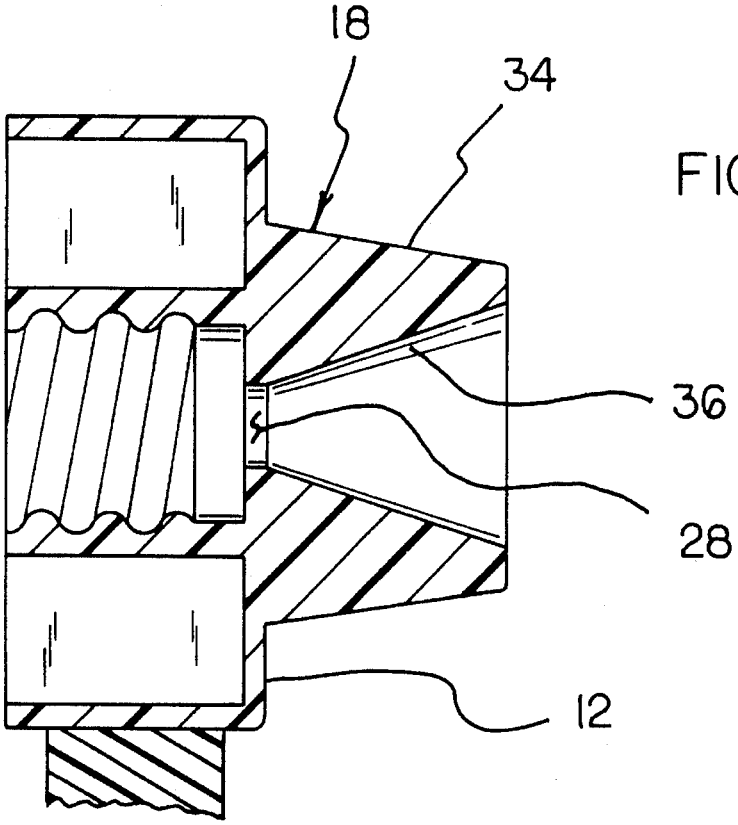
FIG. 7 is a cross-sectional view taken along line 7—7 of FIG. 2.
Figure 8:
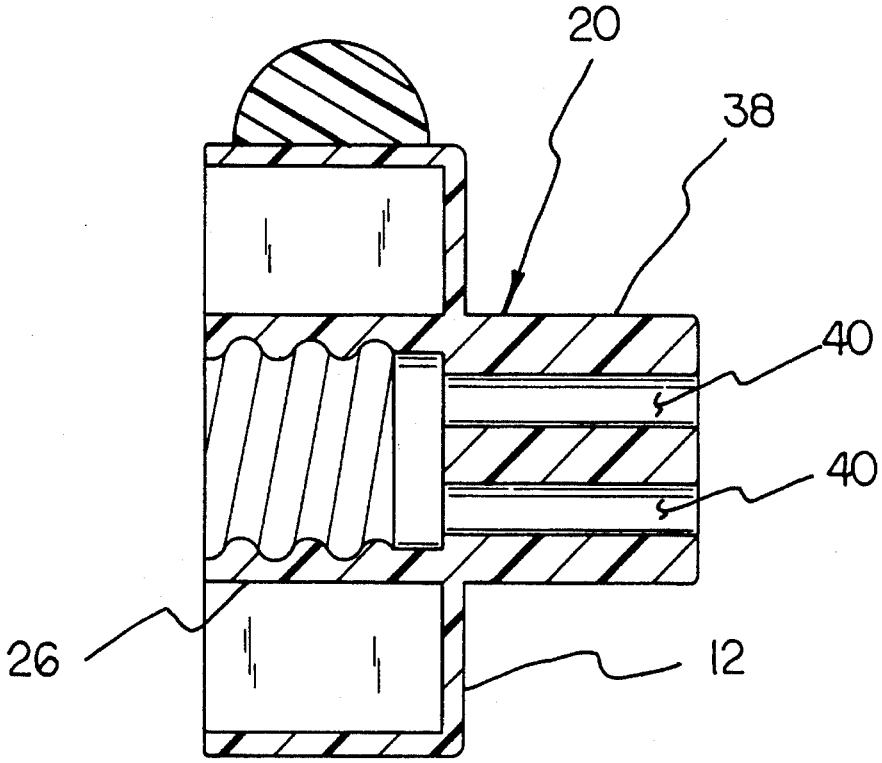
FIG. 8 is a cross-sectional view taken along line 8—8 of FIG. 2.

Referring to FIGS. 6 through 8, wherein the nozzle means 14, 18, and 20 are illustrated in detail, it can be shown that the first nozzle means 14 of the present invention 10 preferably comprises a threaded receiver 26 secured to an interior surface of the manifold 12 and including interior threads cooperable with exterior threads of a flexible container 16 to which the device 10 is to be attached. A center aperture 28 is directed through the manifold 12 and positioned in communication with an interior of the threaded receiver 26 substantially as shown in the drawings. The first nozzle means 14 further comprises a diffusing nozzle 30 coupled to an exterior surface of the manifold 12 and positioned so as to extend over the center aperture 28 directed therethrough. The diffusing nozzle 30 includes an annular array of radially extending slots 32 which cooperate to project fluid directed through the first nozzle means 14 into a desired spray pattern and direction.

Referring now to FIG. 7, it can be shown that the second nozzle means 18 according to the present invention 10 preferably comprises a threaded receiver 26 coupled to an interior surface of the manifold 12 and including interior threads cooperable with exterior threads of a flexible container 16 to which the device 10 is to be associated with. A center aperture 28 is directed through the manifold 12 and positioned in contiguous communication with an interior surface of the threaded receiver 26 so as to permit fluid communication therethrough. The second nozzle means 18 according to the present invention further includes an expanding nozzle 34 coupled to an exterior surface of the manifold 12 and positioned so as to extend circumferentially about the center aperture 28. The expanding nozzle 34 is shaped so as to define a conical bore 36 tapering from a first diameter substantially equal to a diameter of the center aperture 28 to a second diameter spaced from the center aperture 28, wherein the second diameter is substantially greater than the first diameter. By this structure, fluid forcibly directed from a flexible container 16 through the center aperture 28 of the manifold 12 will be projected from the expanding nozzle 34 in a desired spray pattern and direction.

Referring now to FIG. 8, it can be shown that the third nozzle means 20 according to the present invention 10 comprises a threaded receiver 26 extending from an interior surface of the manifold 12. A directing nozzle 38 is coupled to an exterior surface of the manifold 12 and includes a plurality of parallel apertures 40 extending through the directing nozzle 38 and into fluid communication with an interior of the threaded receiver 26. By this structure, fluid forcibly expelled from a flexible container 16 attached to the threaded receiver 26 of the third nozzle means 20 will be projected from the directing nozzle 38 in a desired spray pattern and direction.

In use, the flexible container toy nozzle 10 according to the present invention can be easily secured to one or more flexible containers 16, whereby a collapsing of the containers will forcibly direct fluid therefrom to be projected from the device 10 in a desired pattern and direction.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A flexible container toy nozzle comprising: a manifold; and, a first nozzle means secured to the manifold for coupling to a flexible container and for directing fluid forcibly expelled from the collapsible container in a first spray pattern and direction and further comprising a second nozzle means secured to the manifold for coupling to a flexible container and for directing fluid forcibly expelled from the collapsible container in a second spray pattern and direction, wherein the spray pattern of the first nozzle means is different than a spray pattern of the second nozzle means and further comprising a third nozzle means secured to the manifold for coupling to a flexible container and for directing fluid forcibly expelled from the collapsible container is a third splay pattern and direction, wherein the spray pattern of the third nozzle means is different from the spray pattern of the second nozzle means and further comprising a handle secured to and projecting downwardly from a lower surface of the manifold for permitting manual manipulation of the nozzle.

2. The flexible container toy nozzle of claim 1, and further comprising a plurality of aiming projections extending from surfaces of the manifold and each being aligned with an individual one of the nozzle means.

3. The flexible container toy nozzle of claim 1, wherein the first nozzle means comprises a threaded receiver secured to an interior surface of the manifold and including interior threads cooperable with exterior threads of a flexible container, the manifold being shaped so as to define a center aperture directed therethrough positioned in communication with an interior of the threaded receiver; and a diffusing nozzle coupled to an exterior surface of the manifold and positioned so as to extend over the center aperture, the diffusing nozzle including an annular array of radially extending slots which cooperate to project fluid directed through the first nozzle means into a first spray pattern and direction.

4. The flexible container toy nozzle of claim 3, wherein the second nozzle means comprises a threaded receiver coupled to an interior surface of the manifold and including interior threads cooperable with exterior threads of a flexible container, the manifold being shaped so as to define a center aperture directed therethrough positioned in contiguous communication with an interior surface of the threaded receiver so as to permit fluid communication therethrough; and an expanding nozzle coupled to an exterior surface of the manifold and positioned so as to extend circumferentially about the center aperture, the expanding nozzle being shaped so as to define a conical bore tapering from a first-diameter substantially equal to a diameter of the center aperture to a second diameter spaced from the center aperture, wherein the second diameter is substantially greater than the first diameter.

5. The flexible container toy nozzle of claim 4, wherein the third nozzle means comprises a threaded receiver extending from an interior surface of the manifold; and a directing nozzle coupled to an exterior surface of the manifold, the directing nozzle including a plurality of parallel apertures extending through the directing nozzle and into fluid communication with an interior of the threaded receiver.

* * * * *